US005667088A

United States Patent [19]

King et al.

[11] Patent Number: 5,667,088

[45] Date of Patent: Sep. 16, 1997

[54] CONTAINER CLOSURES

[75] Inventors: Roger Milner King; Witney Milner King, both of Latimer Bucks, United Kingdom

[73] Assignee: Beeson and Sons Limited, Rickmansworth, United Kingdom

[21] Appl. No.: 317,999

[22] Filed: Oct. 4, 1994

[30] Foreign Application Priority Data

Oct. 4, 1993 [GB] United Kingdom ..... 9320389

[51] Int. Cl.[6] ..... B65D 41/34

[52] U.S. Cl. ..... 215/252; 215/221; 215/334; 215/44

[58] Field of Search ..... 215/252, 209, 215/221, 330, 334, 44

[56] References Cited

U.S. PATENT DOCUMENTS

| | | | |
|---|---|---|---|
| D. 327,644 | 7/1992 | Offley et al. . | |
| D. 329,980 | 10/1992 | Powell et al. . | |
| 3,347,403 | 10/1967 | Lehrman . | |
| 3,581,926 | 6/1971 | Roder | 215/330 |
| 3,737,064 | 6/1973 | Patel et al. . | |
| 3,924,769 | 12/1975 | Fillmore . | |
| 3,941,268 | 3/1976 | Owens et al. . | |
| 3,944,102 | 3/1976 | Grau . | |
| 4,147,268 | 4/1979 | Patel et al. . | |
| 4,157,144 | 6/1979 | Weiler et al. . | |
| 4,273,248 | 6/1981 | Lehmann . | |
| 4,289,248 | 9/1981 | Lynn . | |
| 4,310,101 | 1/1982 | Sekine | 215/330 |
| 4,387,822 | 6/1983 | Lynn . | |
| 4,469,235 | 9/1984 | Parker . | |
| 4,493,427 | 1/1985 | Wolkonsky . | |
| 4,524,876 | 6/1985 | Kusz . | |
| 4,562,931 | 1/1986 | Brach et al. . | |
| 4,591,063 | 5/1986 | Geiger | 215/330 |
| 4,658,977 | 4/1987 | Crisci . | |
| 4,679,696 | 7/1987 | Bonnenfant et al. | 215/252 |
| 4,731,512 | 3/1988 | Barriac . | |
| 4,746,026 | 5/1988 | Leonhardt . | |
| 4,770,308 | 9/1988 | Lynn . | |
| 4,813,561 | 3/1989 | Ochs | 215/252 |
| 4,813,562 | 3/1989 | Begley | 215/252 |
| 4,905,852 | 3/1990 | Zumbuhl . | |
| 4,936,474 | 6/1990 | Szczesniak et al. . | |
| 5,050,754 | 9/1991 | Marino . | |
| 5,103,991 | 4/1992 | Collins . | |
| 5,213,225 | 5/1993 | King et al. . | |
| 5,219,084 | 6/1993 | King . | |

FOREIGN PATENT DOCUMENTS

| | | |
|---|---|---|
| 117948 | 9/1984 | European Pat. Off. . |
| 2036272 | 12/1970 | France . |
| 2558443 | 7/1985 | France . |
| 2572369 | 5/1986 | France . |
| 36 05 963 | 8/1987 | Germany . |
| 2134873 | 8/1984 | United Kingdom . |
| 2163732 | 3/1986 | United Kingdom . |
| 2261656 | 5/1993 | United Kingdom . |
| 2262280 | 6/1993 | United Kingdom . |
| WO91/01925 | 2/1991 | WIPO . |
| WO91/18799 | 12/1991 | WIPO . |
| WO93/01098 | 1/1993 | WIPO . |
| WO94/11267 | 5/1994 | WIPO . |

*Primary Examiner*—Stephen Cronin
*Attorney, Agent, or Firm*—Brinks Hofer Gilson & Lione

[57] ABSTRACT

A container closure assembly comprises a container neck, a closure for the neck and a tamper evident ring frangibly coupled to the closure and retained on the neck when the closure is removed from the neck, wherein the tamper-evident ring has a generally non-circular shape. Preferably, the tamper-evident ring is substantially polygonal, e.g. substantially square, with outwardly curved sides and arcuate corners. The tamper-evident ring is retained on the neck by hooks that abut against a shoulder on the container neck.

8 Claims, 7 Drawing Sheets

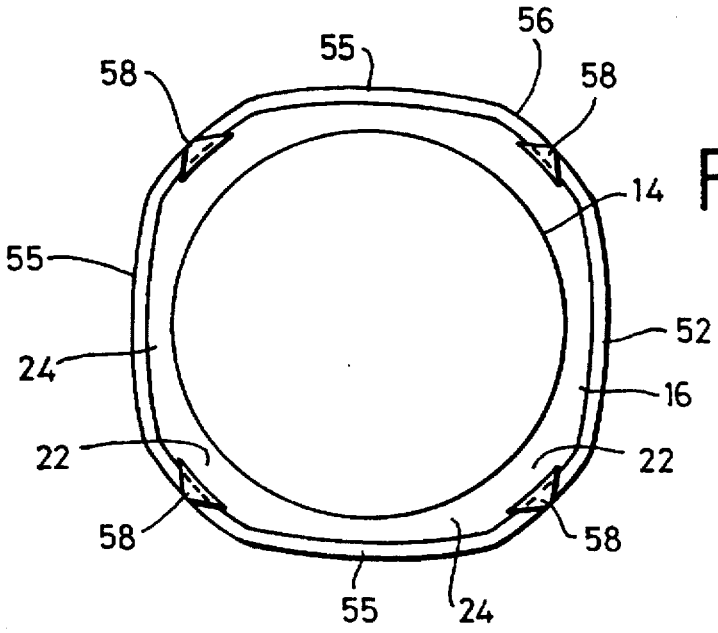
FIG. 2
FIG. 3
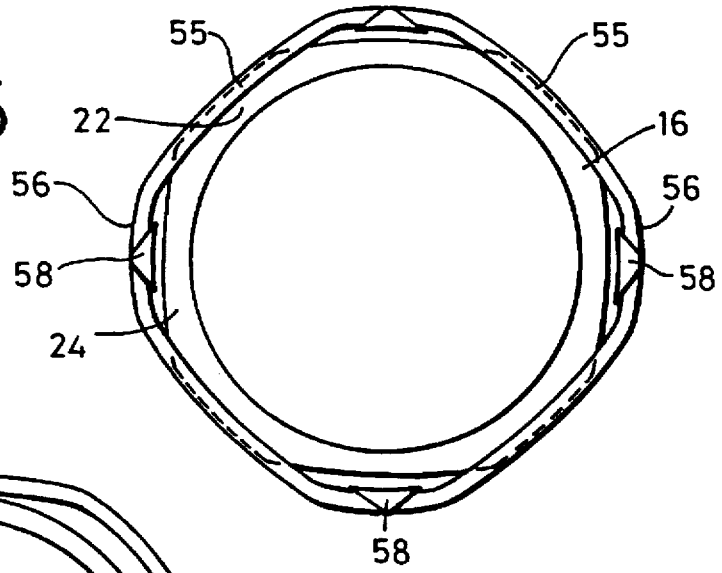
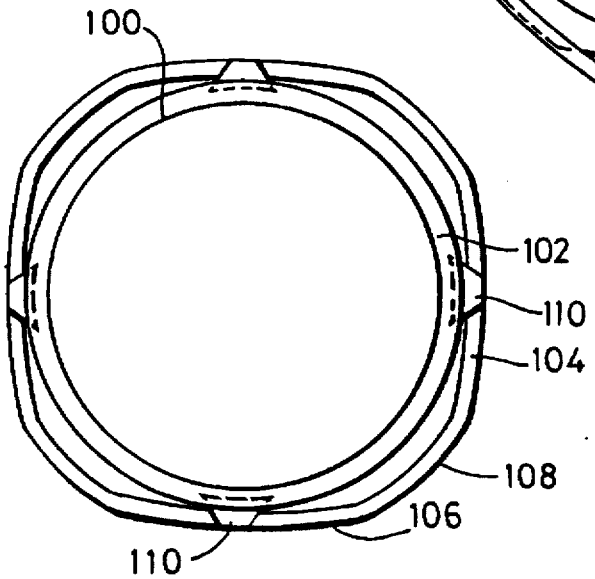
FIG. 5

CONTAINER CLOSURES

BACKGROUND OF THE INVENTION

This invention concerns improvements relating to container closures. In one part, the invention relates to a tamper evident feature for a container closure. In another part, the invention relates to a sealing feature for a container closure.

SUMMARY OF THE INVENTION

A container closure assembly in accordance with a first aspect of this invention comprises a container neck, a closure for the neck, and a tamper evident ring releasably coupled to the closure and retained on the neck when the closure is removed from the neck, wherein the tamper evident ring has a generally non-circular shape.

With such an assembly, the closure does not have to be designed specifically to use a circular tamper evident ring, which is the conventional form of the ring. Preferably, the closure has a generally non-circular shape. Preferably, the shape of the tamper evident ring matches the shape of the closure.

For example, the tamper evident ring may have a generally rectangular or other polygonal shape. The sides of the polygon may be curved slightly. In one preferred form, the ring has a generally square shape. The sides are curved gently such that they appear to bulge from the strict square shape. The corners are rounded with smooth arcuate segments. Preferably, the arcuate segments are segments of a circle of radius equal to the distance to the central axis of the ring.

Preferably, the tamper evident ring comprises a plurality of hooks or lugs which project inwardly towards the neck. The hooks are designed to enable the tamper evident ring to fit on to the neck when the closure is initially applied to the neck, the hooks then engaging against one or more projections of the neck to retain the tamper evident ring on the neck.

The hooks are preferably as described in our prior PCT patent application no. PCT/GB93/02341. A particularly preferred feature is that the hooks are resiliently flexible relative to the ring. Preferably, the hooks are inclined inwardly relative to the ring.

Preferably, the hooks are arranged such that portions of the hooks lie on a pitch circle diameter. In on form, at least the tips of the hooks lie on the pitch circle diameter. With this design, the hooks have a "circular" relation, as in conventional circular tamper evident rings. This enables the tamper evident ring to behave as a circular ring so far as the hooks are concerned, even though the ring has a non-circular geometry.

In one form of the invention, the hooks are arranged at portions of the ring which are radially outermost from the central axis of the ring. For example, in the case of the square shaped ring referred to above, hooks may be arranged one at each of the circularly rounded corners of the square.

Preferably, the ring is coupled initially to the closure by means of severable connections. Such connections may be in the form of thin shearable bridges or "wires" extending between the ring and the closure. Preferably, such bridges are provide at least in the regions which are adjacent to the hooks. This can ensure reliable severing of the bridges when the closure is removed on the first occasion. In the case of the square shaped ring, pairs of bridges may be provided at the rounded corners one on either side of each hook. Additional stabilising bridges may provided at the central portions of the relatively straight sides of the ring's square shape.

Preferably, the container neck comprises a projecting shoulder behind which the hooks locate to retain the tamper evident ring on the neck. Preferably the shoulder is shaped such that the tamper evident ring is capable of fitting over the shoulder without substantial interference (except by the hooks) when the ring is aligned relative to the shoulder. For example, the shoulder may have the same external shape as the shape of the central opening in the ring. In a preferred form, this shape is the square section shape with rounded corners. Thus the shoulder will have corner portions which are further from the central axis of the neck than other portions of the shoulder.

In the case of a square tamper evident ring with hooks at the corners, the projecting shoulder must project radially to cover at least the tips of the hooks, which means that the shoulder may project radially beyond the relatively straight sides of the ring's square shape. By providing the corner portions of the projecting shoulder aligned at the positions of the hooks when the ring is fitted to the neck, the straight sides of the ring's square shape can be arranged such that the shoulder will not interfere with the sides of the ring as the ring is fitted to the neck; that is to say, the straight sides will not have to ride over the corner portions of the shoulder when the tamper evident ring is fitted on to the neck.

Preferably, the screw threads are arranged such that when the tamper evident ring is passing over the shoulder, the closure is oriented relative to the neck such that the ring and the shoulder are substantially in alignment, such that the ring can fit easily over the shoulder.

It will be appreciated that the shoulder could also be formed as a plurality of angularly spaced shoulder segments which segments are intended for engaging the hooks of the tamper evident ring.

Once the ring has been separated from the closure, the ring will be retained on the neck by the shoulder. Even if the ring is rotated relative to the neck such that the hooks are no longer in alignment with the corner portions of the shoulder, the shoulder can still overlap the relatively straight edges of the ring's square shape to prevent the ring from rising above the shoulder. However, it is preferred that the hooks should engage the corner portions of the shoulder when the ring is intact with the closure, thereby to provide reliable separation of the ring when the closure is removed for the first time.

Preferably, the closure and/or the ring are arranged relative to the closure such that the ring will be in a predetermined orientation relative to the neck when the closure is in its closed position. This is particularly useful in combination with the special shape of the shoulder for engaging the hooks as discussed above.

Preferably, the neck comprises means for restricting rotation of the ring relative to the neck. Such means may comprise one or more ratchet projections for engaging the hooks of the ring. The ratchet projections may be shaped to permit rotation of the ring in a direction to screw the closure on to the neck, but to halt or to restrain rotation of the ring in a direction to unscrew the closure. Such a feature provides a rotational shearing effect to ensure reliable separation of the ring from the closure when the closure is removed on the first occasion. Preferably, the ratchet projections are positioned adjacent to the shoulder or shoulder segments on the side thereof further from the open end of the neck. Preferably, the ratchet projections are as described in international patent application no. PCT/GB93/02341.

As an alternative to the hooks being positioned at the corners of the ring's square shape, the hooks may instead be positioned along the relatively straight sides. For example, the hooks may be positioned at the centre of each side. Hooks could also be positioned substantially all around the periphery of the ring. Typically, such hooks may be of different sizes such that they lie on a pitch circle. It will be appreciated that the above preferred features could be adapted to match different positions of the hooks on the ring.

Although the above features have been described in preferred forms as relating to a generally square-shaped ring, it will be appreciated that the same principles and preferred features can be applied to other shapes of non-circular tamper evident ring.

Preferably, the neck and closure comprise complementary screw threads. The closure may be applied or removed by rotation through about 360 degrees or less, preferably 180 degrees or less. In a preferred embodiment, the required rotation is about 90 degrees or less, to provide approximately only a quarter of a turn. Preferably, the threads are fast pitch threads such that the tamper evident ring will be driven over the shoulder with only limited rotation of the closure when the closure is fitted initially to the neck.

Preferably, the assembly further comprises locking means for retaining the closure in its fully closed position on the neck. Such locking means may comprise mutually engageable locking elements which engage when the closure is rotated into its closed position, and which hold the closure until a predetermined release torque is applied to the closure. The disclosure of published patent application PCT/GB92/00850 corresponds to the disclosure of U.S. Pat. Nos. 5,213,225 and 5,454,476, both of whose entire contents are incorporated herein by reference. Furthermore, the disclosure of published patent application PCT/GB92/01255 corresponds to the disclosure of U.S. Pat. No. 5,411,157, whose entire contents are incorporated herein by reference. Such locking elements may be as described in our prior published patent applications Nos. PCT/GB91/00850 and PCT/GB92/01255.

Preferably, the assembly further comprises means for forming a seal against the neck. Such means may comprise a peel off web arrangement (as described below) and/or it may comprise one or more sealing surfaces, such as described in our prior patent application Nos. PCT/GB91/00850, PCT/GB92/01255 and GB 9316938.1.

In a second aspect, the invention provides a container closure with a non-circular tamper evident ring, the closure being adapted for use in the assembly described above. The container closure may include any of the preferred features described above.

A container closure assembly in accordance with a further aspect of this invention comprises a screw threaded container neck, a screw threaded closure for the neck, means for defining a predetermined closed orientation of the closure on the neck, a removable sealing web secured over the open end of the neck, and a resiliently deformable sealing member received in the closure, wherein when the closure is fitted over the sealing web prior to removal of the web, the sealing member deforms to accommodate the sealing web, and when the closure is fitted to the neck after removal of the sealing web, the sealing member bears resiliently against the open end of the neck to seal thereagainst.

Preferably, the sealing web is substantially entirely removable from the container neck. For example, the sealing web may comprise a peel-off or lift-off web.

Preferably, the sealing member received in the closure comprises a member which is compressible in an axial direction relative to the axis of the closure. For example, the sealing member may comprise a laminate structure including a lower layer of plastics or of card and an upper or central layer of compressible material.

Preferably, the sealing member is retained in the closure to avoid the sealing member coming loose when the closure is removed from the neck. For example, retaining projections may be provided to retain the sealing member against or adjacent to a top panel of the closure. Preferably, the sealing member can be snap-fitted into position in the closure.

The means for defining a closed orientation of the closure on the neck may comprise mutually engageable looking elements on the neck and closure which engage when the closure reaches a predetermined closed position. Such engageable locking elements may be as described in our prior patent application Nos. PCT/GB91/00850 and PCT/GB92/01255.

Preferably, the neck and closure further comprise sealing surfaces which seat substantially against one another when the closure is in its closed orientation. Such sealing surfaces may be tapered as shown in our International patent application No. PCT/GB92/01255. The assembly may also include a fine sealing ridge such as disclosed in our UK patent application No. 9316938.1 to achieve a substantially air-tight seal. U.K. patent application no. 9316938.1 generally corresponds to U.S. patent application Ser. No. 08/619,120, whose entire contents are incorporated herein by reference.

Although the above aspects of the invention may be used in isolation, a particularly advantageous structure is achieved by using the above aspects in combination.

Embodiments of the invention are now described by way of example only, with reference to the accompanying drawings, in which:

BRIEF DESCRIPTION OF THE DRAWINGS

FIGS. 2 and 3 are explanatory views showing application of the closure to the neck;

FIG. 5 is a schematic plan view through a second embodiment of closure;

DESCRIPTION OF THE PREFERRED EMBODIMENT(S)

Figure 1:
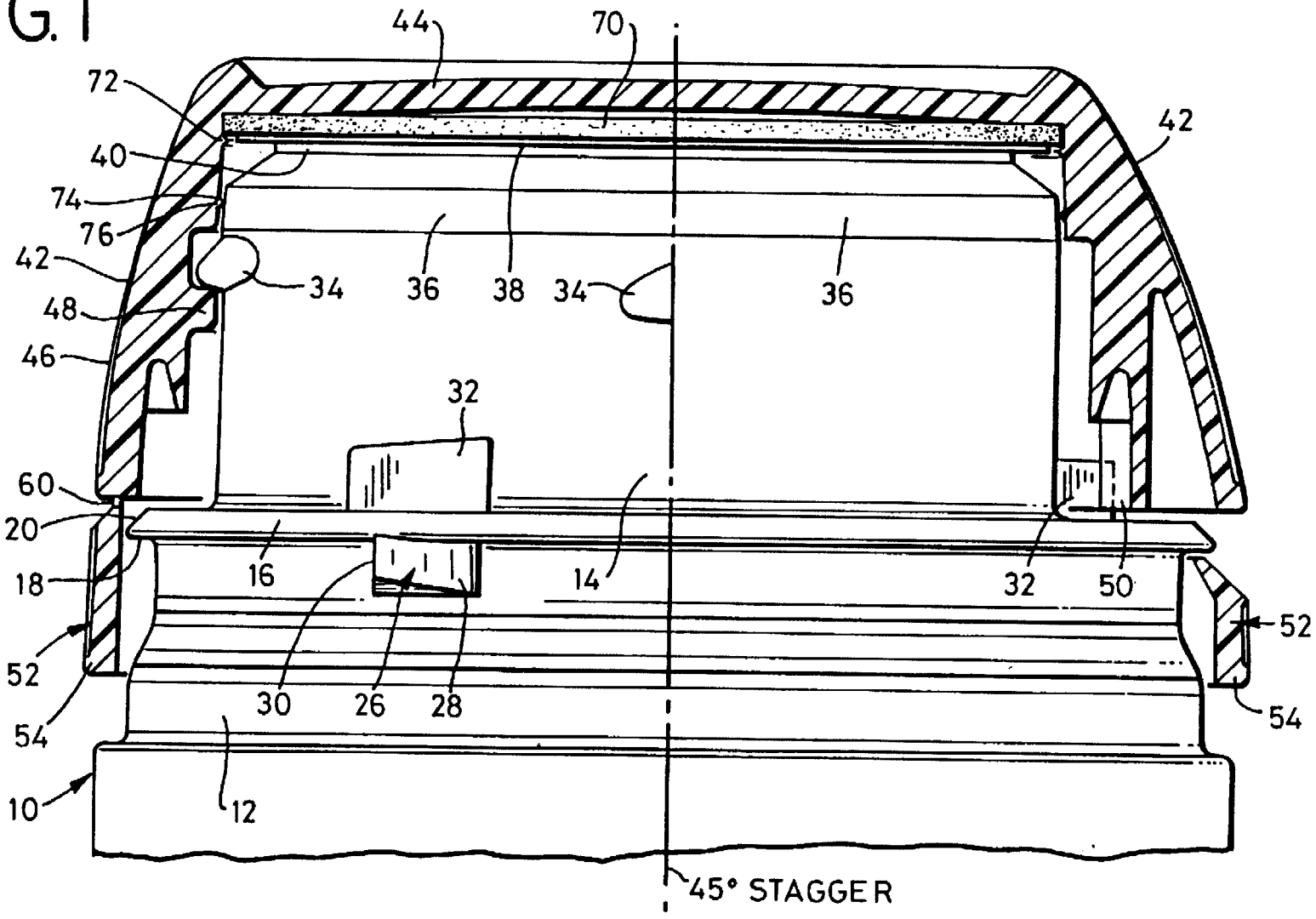
FIG. 1 is a schematic staggered section through a first embodiment of container closure assembly.

Referring to FIGS. 1–4, a container has a generally square-section body 10 from which extends a lower neck 12 and an upper neck 14. The lower neck is of a similar square section shape, but with a smaller dimension. The upper neck 14 is generally cylindrically shaped, with a diameter smaller than the lateral dimension of the lower neck 12. A shoulder 16 joins the lower neck to the upper neck. The shoulder 16 also has a generally square shape and projects radially outwardly of the lower neck 12 to form a lower abutment surface 18. The upper surface of the shoulder has a chamfered edge 20. The container and neck may be made of any suitable material such as glass or plastics.

Figure 4:
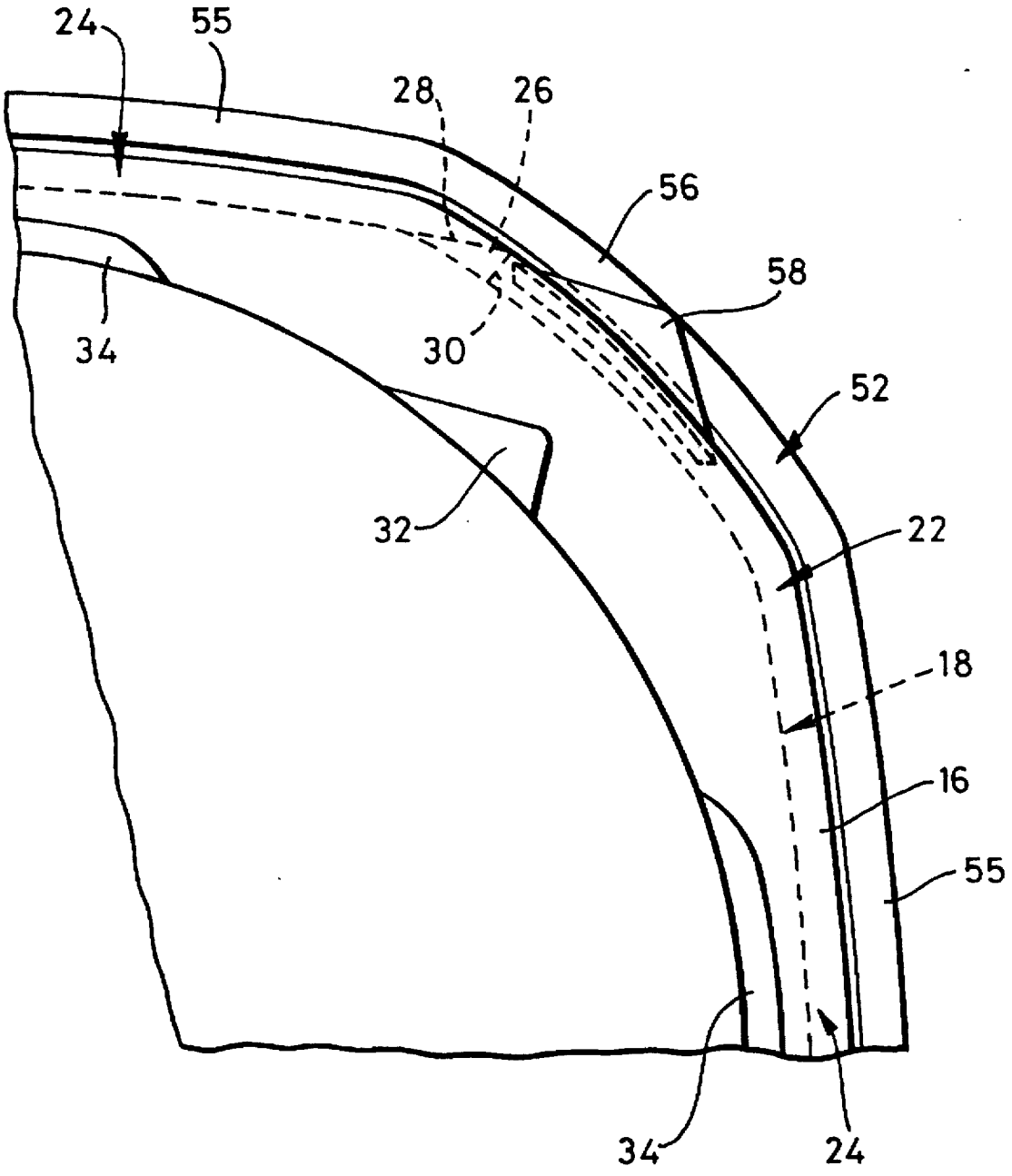
FIG. 4 is a schematic plan view showing a detail of the closure in its closed condition on the neck.

As best seen in FIGS. 2–4, the square section shape of the shoulder 16 has rounded corners 22. The outer edge of each corner is formed as a segment of a circle having the same radius as the distance from the edge to the central axis of the container and neck. The "straight" sides 24 of the square shape are bulged outwardly as a gentle curve. This shape of the shoulder 16 matches a similar cross-sectional shape of the lower neck 12 (see FIG. 2) and of the body 10.

Figure 6:
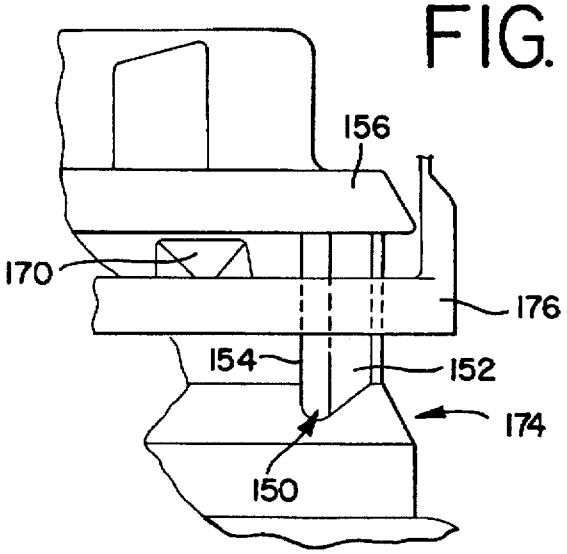
FIG. 6 is a partial side view showing a container neck and tamper evident ring of a further embodiment (in isolation from the closure)
Figure 7:
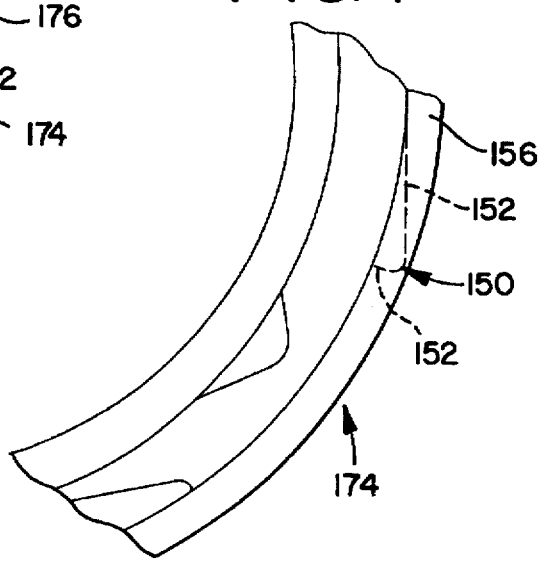
FIG. 7 is a partial section from above illustrating how the ring co-operates with the container neck of FIG. 6.

A ratchet stop 26 is formed adjacent to the abutment surface 18 of the shoulder 16 at each of the four carrier regions 22. Each ratchet stop 26 is positioned towards the counter-clockwise end (as viewed from above, see FIG. 4) of the corner region 22. The ratchet stop 26 has a ramp surface 28 tapering radially inwardly in the counter-clockwise direction, and a substantially radial abutment surface 30. The detail of the ratchet stops is as described in our prior international patent application no. PCT/GB93/02341. As described in international patent application no. PCT/GB93/02341 and shown in FIGS. 6 and 7, each stop formation 150 has a circumferential ramp surface 152 and a substantially radial abutment surface 154.

Figure 8:
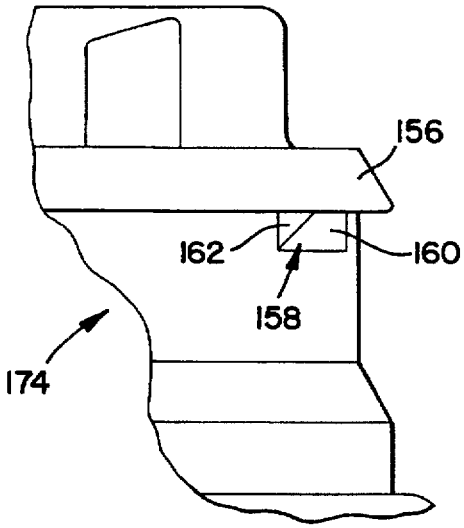
FIG. 8 shows a modified neck arrangement.
Figure 9:
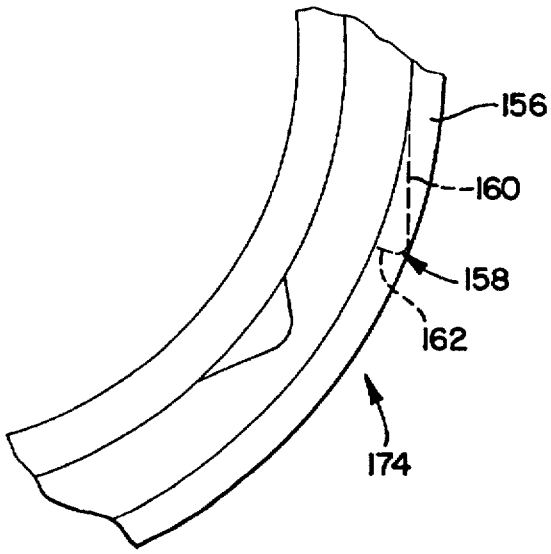
FIG. 9 is a partial sectional view from above of the neck illustrated in FIG. 8.
Figure 10:
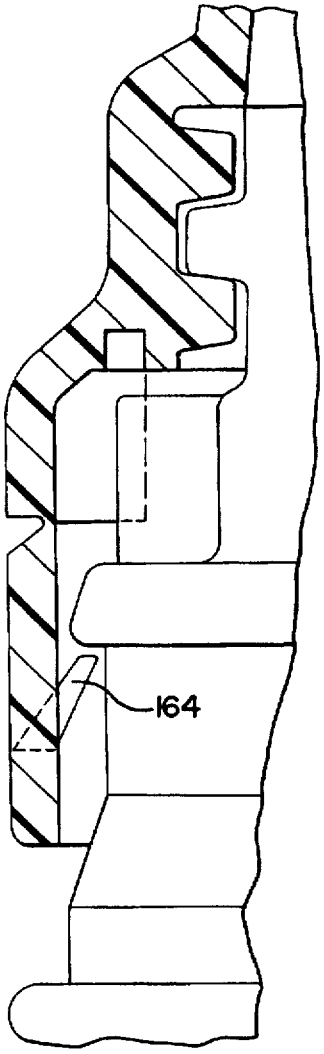
FIG. 10 is a sectional view showing a tamper evident ring installed in a container closure assembly.
Figure 12:
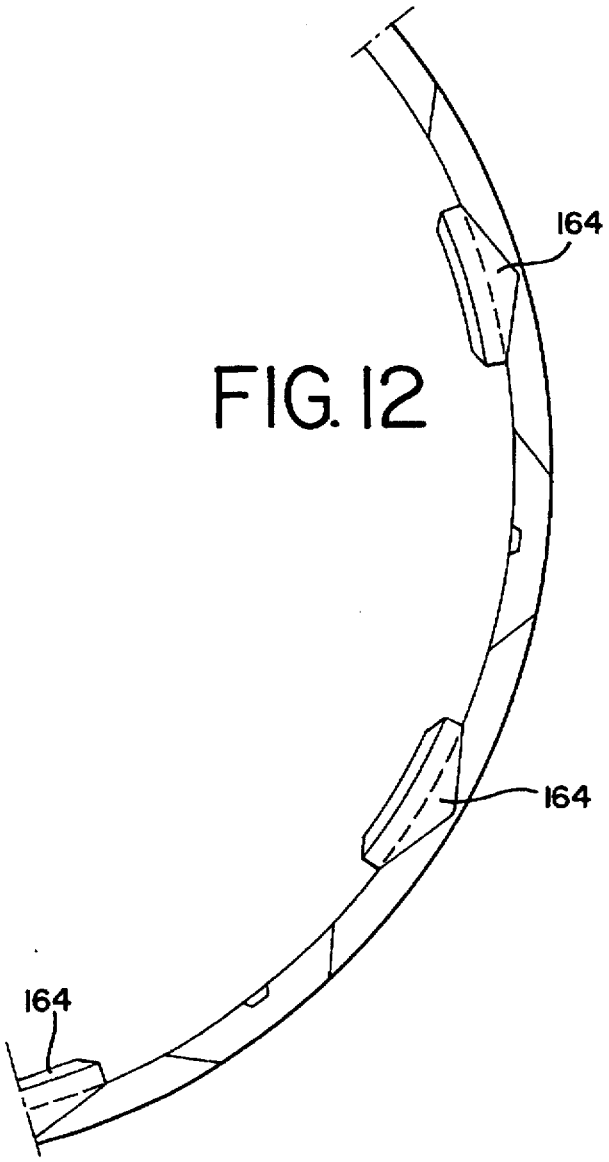
FIG. 12 is a plan view showing a portion of the tamper evident ring of FIG. 10 in isolation.
Figure 11:
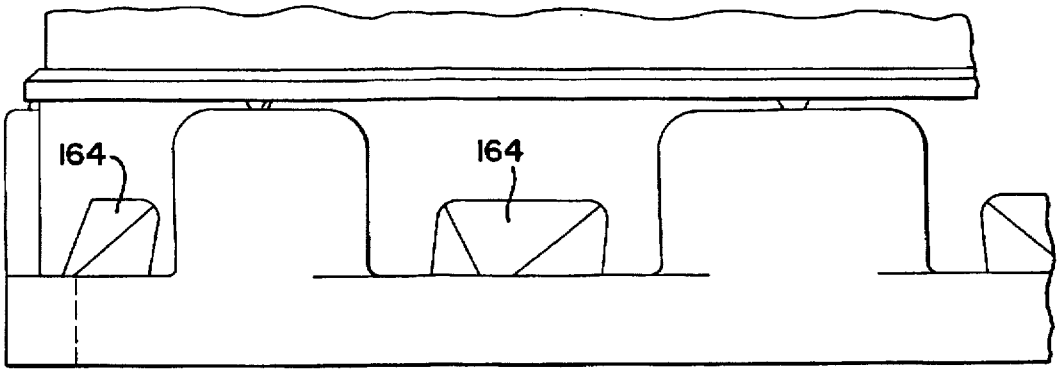
FIG. 11 is a side view of a portion of the assembly of FIG. 10.
Figure 13:
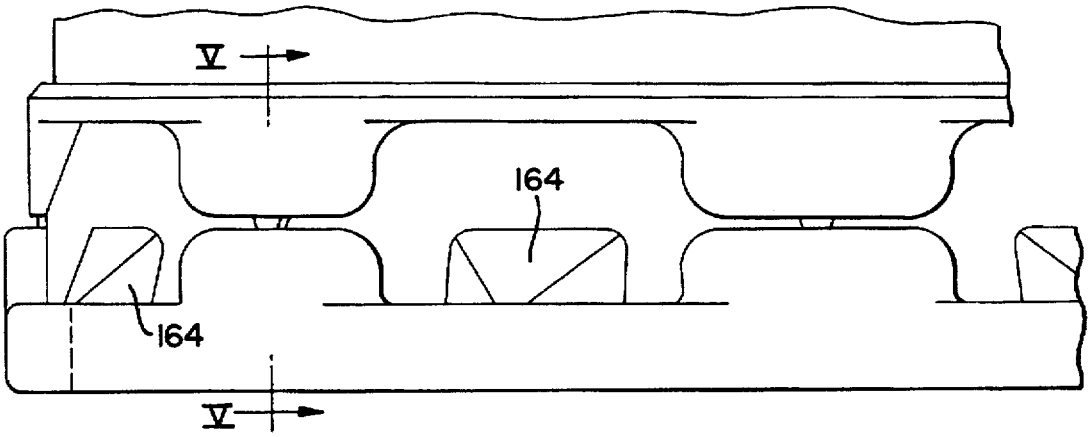
FIG. 13 is a similar view to FIG. 11 but showing a modified form of ring.
Figure 14:
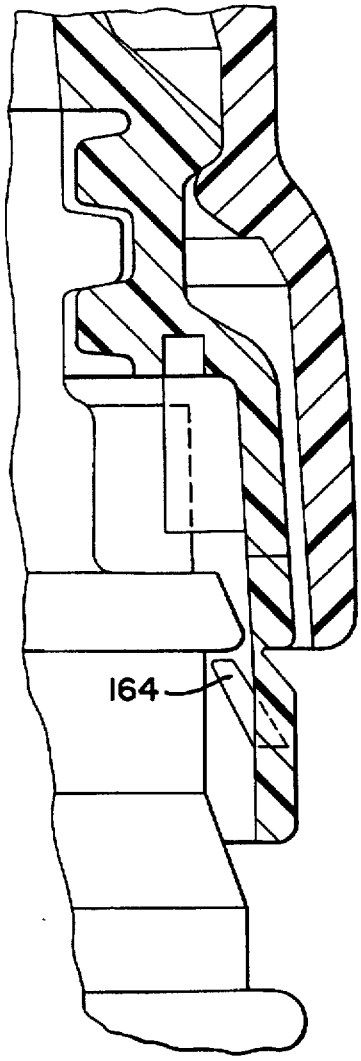
FIG. 14 is a sectional view showing the ring of FIG. 10 installed on a child-resistant container closure assembly.
Figure 15:
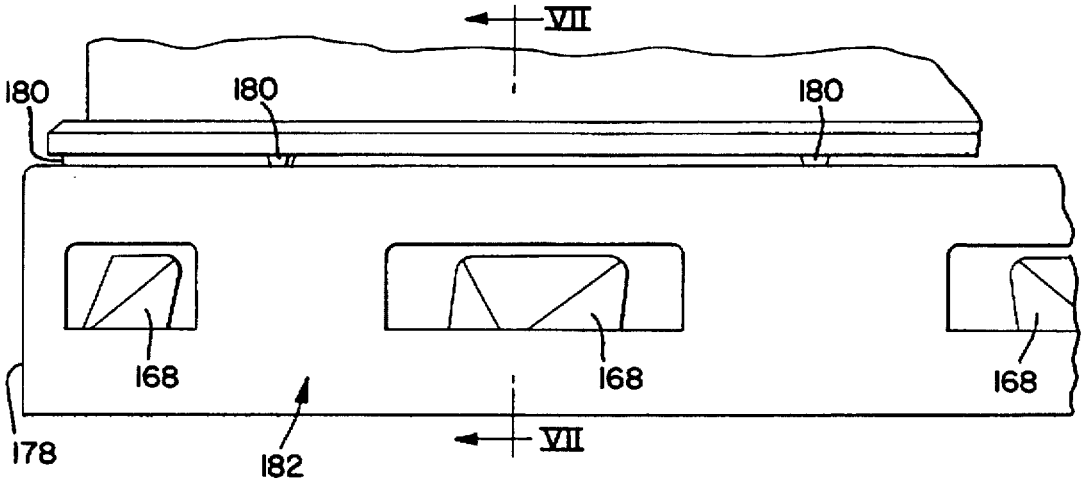
FIG. 15 is a view similar to FIG. 11 but showing a further modified form of ring.
Figure 16:
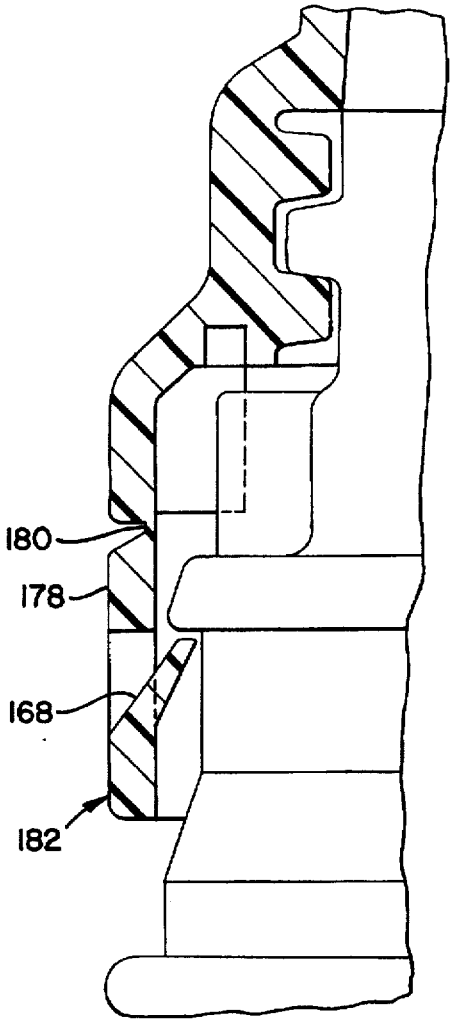
FIG. 16 is a sectional view along the ling VII—VII of FIG. 15 but showing the closure fitted to a container neck.

As described in international patent application no. PCT/GB93/02341 and as shown in FIGS. 8 and 9, the stop formation 96 is chamfered radially inwardly as they extend below the rim 156. The axial length of the formation 158 is less than that of the formation 150 described above. The formation 158 has a respective circumferential ramp surface 160 similar to the ramp surface 152 described above, and a triangular shaped abutment surface 162 similar to the abutment surface 154 described above. It will be appreciated that other design of stop formations or ratchet stops could also be used. For example, as described in international patent application no. PCT/GB93/02341 and as shown in FIGS. 10–14, the fingers (or tabs) 164 are each inclined upwardly and radially inwardly, and taper towards their free ends. In addition, as described in international patent application no. PCT/GB93/02341 and as shown in FIGS. 15 and 16, the tabs 168 are able to "hinge" and bend resiliently without stressing the cylindrical wall 178, and without risking damage to the severable connections 180 which join the upper edge of the rim 182 to the lower edge of the closure.

Two locking elements 32 are formed on the opposite side of the shoulder to the ratchet stops 26. The locking elements 32 are diametrically spaced apart, and are arranged adjacent to a respective two of the four ratchet stops 26.

The upper neck 14 carries a screw thread 34. Above the screw thread 34 is located a tapered sealing surface 36, and above the sealing surface 36 a peelable sealing web 38 is secured to an upstanding rim 40.

A closure 42 comprises a top panel 44 and a depending side wall 46. The closure has a similar cross-sectional shape to match the rounded square-section shape of the body 10 and lower neck 12. The closure 42 includes an interior screw thread 48 to fit the screw thread 34 of the neck. The screw threads permit the closure to be rotated between fully closed on, and disengaged from, the neck by rotation through approximately 80°–90°. The screw threads 34 and 48 each have four thread starts to enable the closure to be placed on the neck in any of four predetermined start orientations. Four locking elements 50 project radially inwardly from the side wall 46 to engage the locking element 32 on the neck when the closure is rotated into its closed position on the neck. Since there are only two elements 32 on the neck, these will be engaged by a respective two of the elements 50 on the closure (depending on in which start orientation the closure is placed on the neck), the remaining two elements 50 being clear of the neck elements 32. The locking elements 32 and 50 provide a positive locking effect to hold the closure in the closed position. The detail of these elements is described in our application Nos. PCT/GB91/00850 and PCT/GB92/01255.

Figure 17:
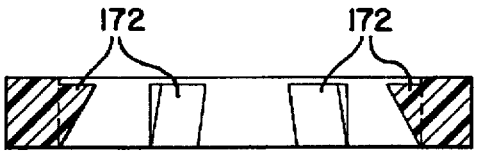
FIG. 17 shows a modified embodiment of the tamper evident ring.

The closure 42 carries a tamper evident ring 52 which depends from the lower edge of the side wall 46. The tamper evident ring 52 has a similar rounded square-section shape to the closure 42 to provide an aesthetically pleasing appearance. The ring 52 comprises a rounded square shaped collar 54 with curved sides 55 and also with rounded corners 56 from which extend four hooks or lugs 58. The detail of the hooks 58 is as described in our international patent application PCT/GB93/02341 and FIG. 17 which describe and show the structure and function of fixed hook or claw projections 172 which project radially inward from the ring. The projections 172 perform the same axial retention/rotation restriction role as the tabs 170 described above. In particular, the hooks are inclined radially inwardly towards the neck. The hooks 58 are resiliently flexible in a radially outward direction relative to the collar 54. The ring 52 is integrally joined to the closure 42 by means of thin severable bridges 60. A pair of bridges 60 is arranged adjacent to each corner 60, with one bridge on either side of the hook 58 located at that corner. This is an optimum location for the bridges 60 because, in use, when the closure is removed from the neck for the first time, the hooks will provide leverage to sever the bridges 60 and thereby detach the ring 52 from the neck. Additional stabilising bridges 60 are also located at the centres of the sides 55.

FIGS. 2–4 illustrate how the closure 42 and tamper evident ring 52 are fitted initially to the neck. When the threads 34 and 48 first begin to engage, the closure will be in a substantially aligned condition relative to the closure, as shown in FIG. 2. In this initial condition, the tamper evident ring 52 will be above the level of the shoulder 16.

As the closure is turned in the clockwise direction (as viewed from above) to draw the closure down on the neck, the closure will each an intermediate position depicted in FIG. 3 at which the tamper evident ring 52 will approach the level of the shoulder 16.

As the closure is turned finally towards its closed position, the tamper evident ring 52 drops below the level of the shoulder 16. The shape of the shoulder 16 is important in not interfering substantially with the tamper evident ring 16 as it drops below the shoulder. It will be appreciated that substantial interference between the shoulder and the tamper evident ring 52 could generate sufficient strain in the severable bridges 60 that some of the bridges could sever prematurely. In particular, it will be appreciated that the sides 55 of the ring 52 lie radially closer to the central axis of the neck and closure than the outermost portions (ie. the corners 22) of the shoulder 16. Therefore, in the present design, the arrangement of the screw threads 34 and 48 in orientating the closure 42 relative to the neck, and the shapes of the shoulder 16 and of the ring 52, are such that when the tamper evident ring 52 is riding over the shoulder, the sides 24 of the shoulder are substantially in register with the sides 55 of the ring 52, thereby to avoid the sides 55 of the ring 52 from fouling against the relative side, corner regions 22 of the shoulder. The resilient hooks 58 flex outwardly as they bear against the chamfered surface 20 of the shoulder, and then spring back into position as the ring 52 passes the shoulder 16 and the closure reaches its fully closed position.

As can be seen in FIG. 4, in the fully closed position of the closure, the hook 58 at each corner 56 of the ring 52 lies adjacent to the abutment surface 30 of each ratchet stop 26. When a person opens the closure 42 for the first time, each hook 56 will be trapped against the abutment surface 18 of the shoulder 16 to retain the ring axially on the neck. Each hook 56 also bears against the abutment surface 30 of the respective ratchet stop 30 to prevent the ring from moving rotationally. Therefore, as the closure 42 is unscrewed, the severable bridges are subjected to axial and torsional stresses which causes the bridges 60 to sever, whereby the ring 52 becomes detached from the closure 42.

As described in international patent application no. PCT/GB93/02341 and shown in FIGS. 8–9, the tabs 170 will also engage against the lower surface of the rim 156 as the closure moves up the thread on the neck 174. Therefore an axial stretching force will also be applied to the severable conditions. By the use of both a torsional shearing force and an axial shearing force, more positive and predictable shearing of the severable connections can be achieved. This is particularly important when the closure is movable through only about 90 degrees (or less) between its closed and opened positions.

It will be appreciated that in this embodiment the tabs 170 have a dual role. Firstly they serve to engage the rim 156 to retain the ring 176 axially on the neck 174. Secondly they serve to engage the stop formations 150 to restrict rotation of the ring 176 relative to the neck 174.

It will also be appreciated that by suitable design of the neck 174, ring 176 and the closure, it is possible to control the relative amounts of torsional stress and axial stress which will be applied to the severable connections when the closure is removed for the first time. For example, this will depend on the orientation of the closure when the stop formations 150 are rotationally engaged, and the orientation when the rim 156 is axially engaged. In some embodiments it may be desirable to have the axial and torsional stresses occurring simultaneously. In other embodiments it may be desirable to have, for example, the torsional stress applied first, followed (upon further rotation of the closure) by the axial stress.

As best seen in FIG. 1, a resiliently compressible sealing wad 70 is retained by projections 72 in the closure 42 adjacent to the top panel 44. The wad 70 serves to form a seal against the open end of the neck once the peelable web 38 has been removed. Prior to removal of the web 38, the wad 70 can compress to accommodate the depth of the web 38 secured over the neck. Once the web 38 has been removed, and the closure 42 replaced on the neck, the wad 70 bears resiliently against the open end thereby to seal the neck.

An additional seal is provided by a second sealing surface 74 on the interior of the closure 42, which second sealing surface 74 is adapted to seal against the tapered sealing surface 36 of the neck. The sealing surface 74 of the closure is formed with a fine ridge 76 (the size of which is enlarged in FIG. 1 for clarity) which concentrates the sealing pressure against the sealing surface 36 on the neck to achieve a substantially air-tight seal. The details of the sealing surfaces are as described in our prior applications Nos. PCT/GB92/01255 and GB 9316938.1.

Although the above embodiment has been described in relation to a generally square shaped tamper evident ring, it will be appreciated that the same principles could be applied to other shapes of tamper evident ring. For example, the ring may have more or less sides than the ring described above.

FIG. 5 illustrates a second embodiment of the present invention. In this embodiment, the shoulder 102 on the container neck 100 is substantially circular. The tamper-evident ring 104 is substantially square with outwardly curved sides 106 and arcuate corners 108 similar to those in the embodiment of FIGS. 1–4. However, in this embodiment the hooks 110 for retaining the tamper-evident ring on the container neck are located adjacent to the mid-points of the four sides 106 of the tamper-evident ring. Thus, it can be seen that the hooks 110 are located at the four radially innermost points of the tamper-evident ring 104, and that the hooks 110 lie on the circumference of a circle entirely within the tamper-evident ring.

The hooks 11 are flexible to flex outwardly when the tamper-evident ring is fitted initially over the shoulder 102. The detailed structure of the flexible hooks is described in international patent application PCT/GB93/02341.

Ratchet projections as hereinbefore described are provided on the container neck 100 below the shoulder 102 to restrict rotation of the tamper-evident ring in an unscrewing direction when the closure is removed from the container neck.

In use, the closure having the tamper evident ring 104 attached thereto is screwed down onto the container neck 100. The hooks 110 flex outwardly to pass over the shoulder 102 and then spring back to retain the tamper evident ring below the shoulder 102. In this way a square tamper-evident ring is fitted to a circular container neck. When the closure is unscrewed, the tamper evident ring is subjected to both axial force (from the abutment between the hooks 110 and the shoulder 102) and torque (from the abutment between the hooks 110 and the ratchet projections on the container neck), resulting in reliable separation of the tamper-evident ring from the closure.

All of the above-cited patent applications are fully incorporated herein by reference. International patent application PCT/GB93/02341 has been published as WO94/11267. International patent application PCT/GB91/00850 has been published as WO91/18788. International patent application PCT/GB92/01255 has been published as WO93/01098.

It will be appreciated that the above description is merely illustrative of preferred forms of the invention, and that modification of detail may be made without departing from the scope and principles of the invention. For example, as described in PCT/GB93/02341, to improve the resilience, each tab may be tapered towards its free end. In one embodiment, each tab is thinned towards its free end to form a resiliently flexible leaf or blade. In addition to being resilient, or as an alternative, one or more of the tabs may be supported at its fixed end by a hinge. The hinge may be integral with the tab and take the form of pliant material.

We claim:

1. A container closure assembly comprising:

a container neck provided with a radially projecting shoulder, wherein the shoulder has a generally circular shape;

a closure for said container neck; and a tamper-evident ring releasably coupled to said closure and retained on said container neck when said closure is removed from said neck, wherein said tamper-evident ring comprising a generally non-circular and polygonal shape and having one or more inwardly projecting hooks located adjacent to the mid-point of one or more sides of said tamper-evident ring, wherein said hooks are located behind said radially projecting shoulder so that the hooks locate to retain the tamper evident ring on the neck.

2. A container closure assembly according to claim 1, wherein said hooks are flexible to flex radially outwardly when said tamper-evident ring is fitted to said container neck.

3. A container closure assembly according to claim 1, further comprising ratchet projections on the container neck to restrict rotation of the tamper-evident ring when the closure is unscrewed from the container neck for the first time.

4. A container closure assembly comprising;

a container neck;

a first thread on the container neck;

a closure for the neck;

a second thread on the closure, said second thread being compatible with said first thread for screwing the closure onto the neck by rotation through approximately 90°;

a tamper evident ring frangibly joined to the closure;

a shoulder on the container neck for retaining said tamper-evident ring on said container neck;

at least one hook on said tamper-evident ring to abut against said shoulder to retain said tamper-evident ring on said container neck; and at least one ratchet projection on said container neck to restrict rotation of said tamper-evident ring when said closure is unscrewed;

wherein said shoulder has a substantially circular shape, said tamper-evident ring has a substantially square shape and said hook is located adjacent a mid-point of a side of said tamper-evident ring.

5. A container closure assembly comprising:

a container neck;

a closure for said container neck; and a tamper-evident ring releasably coupled to said closure and retained on said container neck when said closure is removed from said neck, wherein said tamper-evident ring comprising a generally non-circular and polygonal shape and having one or more inwardly projecting hooks located adjacent to the mid-point of one or more sides of said tamper-evident ring.

6. A container closure assembly comprising:

a container neck having a first screw thread and a generally circular retaining lip located below said first screw thread;

a closure having a second screw thread for securing said closure on said container neck by engagement with said first screw-thread; and a tamper-evident ring releasably coupled to said closure and retained on said container neck when said closure is removed from said neck, said tamper-evident ring comprising a generally polygonal shape and having one or more inwardly projecting hooks located adjacent to the mid-point of one or more sides of said tamper-evident ring to abut against said retaining lip to retain said tamper-evident ring on said container neck.

7. A container closure assembly according to claim 6, wherein said hooks are flexible to flex radially outwardly when said tamper-evident ring is fitted to said container neck.

8. A container closure assembly according to claim 6, further comprising ratchet projections on the container neck to restrict rotation of the tamper-evident ring when the closure is unscrewed from the container neck for the first time.

* * * * *